United States Patent [19]

Greve et al.

[11] 4,010,678

[45] Mar. 8, 1977

[54] METHOD AND APPARATUS FOR MAKING COMPOSITE FILTER PLUGS

[75] Inventors: Heinz Greve, Hamburg; Harry Sprunk, Geesthacht, both of Germany

[73] Assignee: Hauni-Werke Körber & Co., KG, Hamburg, Germany

[22] Filed: July 17, 1975

[21] Appl. No.: 596,812

[30] Foreign Application Priority Data

Aug. 2, 1974 United Kingdom ..... 34130/74

[52] U.S. Cl. ..... 93/77 FT; 198/420

[51] Int. Cl.[2] ..... B65G 47/52

[58] Field of Search ..... 93/1, 77; 198/20 C

[56] References Cited

UNITED STATES PATENTS

| | | | |
|---|---|---|---|
| 2,898,998 | 8/1959 | Schur | 93/77 FT X |
| 2,953,878 | 9/1960 | Schur | 93/1 C UX |
| 3,487,754 | 1/1970 | Flasdieck | 93/77 FT X |
| 3,527,347 | 9/1972 | Marradi | 93/77 FT UX |
| 3,688,652 | 9/1972 | Brodeck | 93/1 C X |
| 3,789,744 | 2/1974 | Wahle | 93/1 C |

*Primary Examiner*—James F. Coan
*Attorney, Agent, or Firm*—Peter K. Kontler; John Kurucz

[57] ABSTRACT

Composite filter plugs or mouthpieces for use in filter cigarette making machines are manufactured by moving rod-like filter components or elements of two or more types sideways or partly sideways and shuffling the filter elements to form a series of groups of assorted coaxial filter elements, pneumatically conveying successive groups of filter elements axially or substantially axially by directing a stream of compressed air against the last filter element of each group, converting the pneumatically conveyed groups of filter elements into a continuous line or file of filter elements, draping a continuous web of cigarette paper or the like around the line of filter elements to form a continuous filter rod, and subdividing the rod into discrete filter plugs each of which contains at least a portion of at least one filter element of each of the several types of filter elements.

24 Claims, 18 Drawing Figures

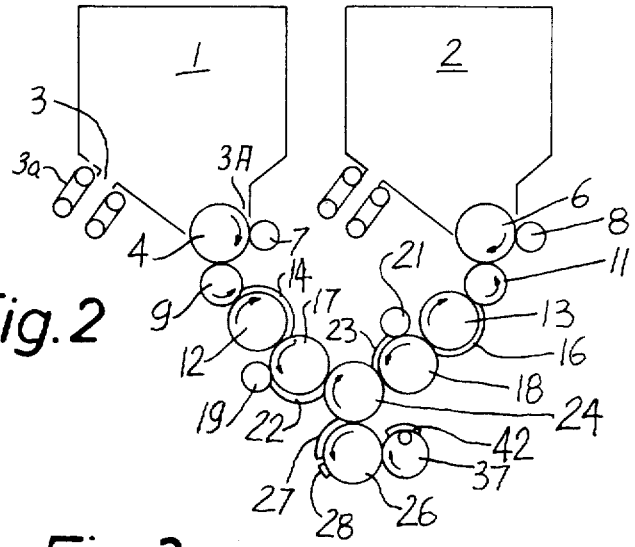
Fig. 2
Fig. 3
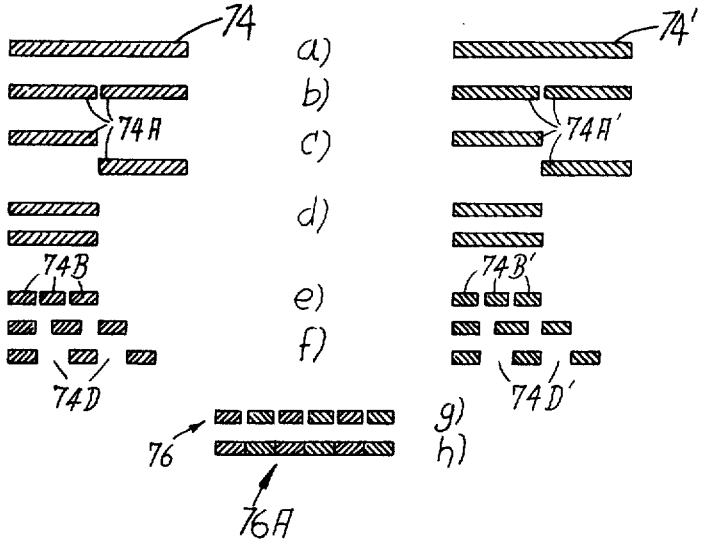

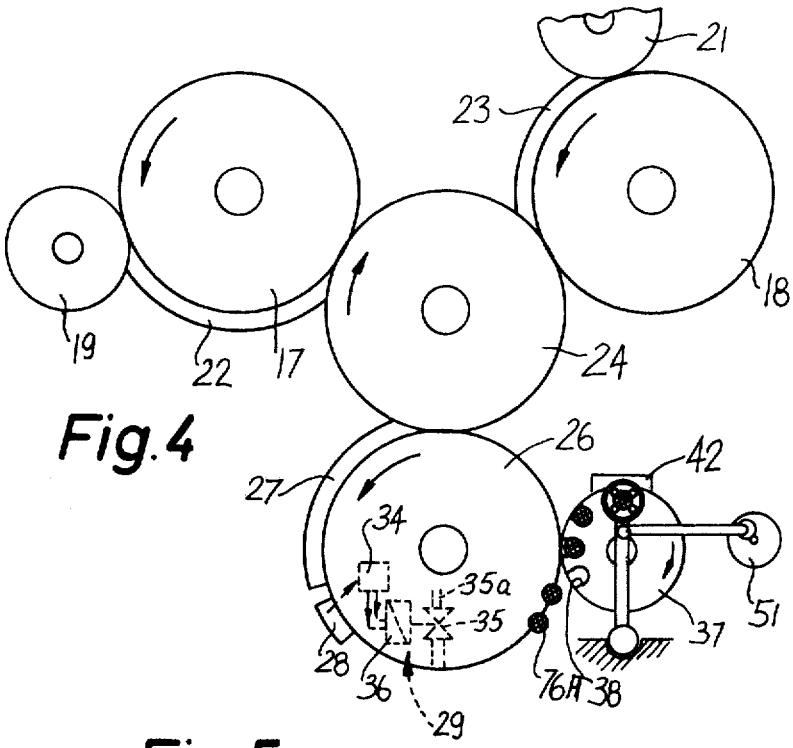
Fig.4
Fig.5
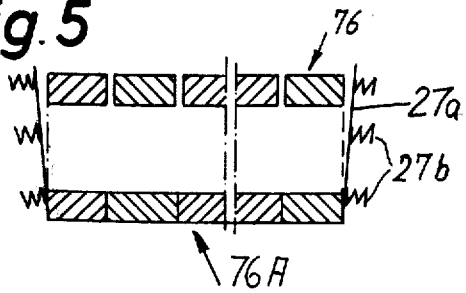
Fig.6
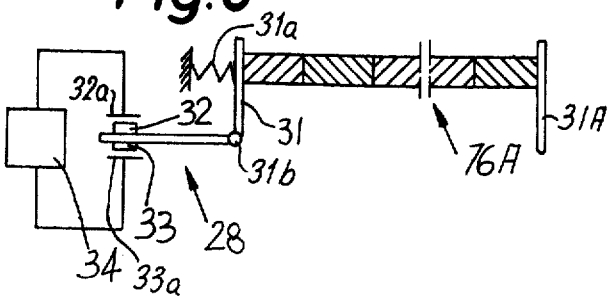

METHOD AND APPARATUS FOR MAKING COMPOSITE FILTER PLUGS

BACKGROUND OF THE INVENTION

The present invention relates to a method and apparatus for the production of composite filter plugs or mouthpieces which can be united with sections of tobacco-containing rods to form therewith filter tipped cigarettes, cigars or cigarillos. More particularly, the invention relates to a method and means for manipulating rod-like filter elements or components of several types prior to and during draping into a web of cigarette paper, imitation cork or other suitable wrapping material to form a continuous filter rod which is thereupon subdivided into composite filter plugs each of which contains at least a portion of at least one filter element of each of several types of such filter elements.

U.S. Pat. No. 2,953,878 to Schur discloses an apparatus for making composite filter plugs wherein filter elements of several types are shuffled to form a series of groups of assorted coaxial filter elements which move sideways. Successive groups are thereupon moved lengthwise exclusively by mechanical means to form a continuous line of filter elements, and the line is wrapped into a continuous web to form a filter rod. The rod is severed at selected points to yield a file of discrete filter plugs each of which contains one or more filter elements of each type. The means for moving successive groups lengthwise comprises an endless chain having spaced-apart lugs each of which engages and pushes the last filter element of a group so that the group advances toward a wrapping station. A drawback of such apparatus and of such mode of making a continuous line of assorted filter elements is that the speed of the chain conveyor is limited and the output of the apparatus is quite low. This will be readily appreciated since the speed at which a group which moves sideways (at zero axial speed) is caused to change its direction of movement (from sidewise to axial or lengthwise) cannot be increased at will without unduly affecting the appearance and/or damaging the filter element which is engaged by a lug.

SUMMARY OF THE INVENTION

An object of the invention is to provide a novel and improved method of making composite filter plugs or mouthpieces for use in machines for the manufacture of filter cigarettes, cigars or cigarillos.

Another object of the invention is to provide a method which can be resorted to for mass production of composite filter plugs wherein two or more different types of rod-shaped filter elements are disposed end-to-end.

A further object of the invention is to provide a method which can be resorted to for mass production of composite filter plugs whose components or elements are free of defects, wherein the percentages of different types of filter material are invariably within an optimum range, and which can be practiced by resorting to relatively simple, compact and versatile apparatus.

An additional object of the invention is to provide a novel and improved apparatus for the production of composite filter plugs or mouthpieces at a rate greatly exceeding the output of presently known apparatus.

Still another object of the invention is to provide the apparatus with novel and improved means for changing the direction of movement of groups of assorted coaxial filter elements of two or more different types.

An additional object of the invention is to provide the apparatus with novel and improved means for assembling rod-like filter elements of two or more types into groups of assorted filter elements.

A further object of the invention is to provide novel and improved conveyor means for use in the assembling means and to provide novel and improved means for converting discrete groups of assorted rod-like filter elements into a continuous line of assorted filter elements which are ready for conversion into a filter rod.

Another object of the invention is to provide novel and improved means for monitoring the length of selected sets or groups of coaxial rod-like filter elements.

A further object of the invention is to provide the apparatus with novel and improved means for guiding successively assembled groups of assorted rod-like filter elements to the location where such groups are converted into a continuous file of filter elements.

One feature of the invention resides in the provision of a method of making composite filter plugs or mouthpieces for cigarettes, cigars or cigarillos. The method comprises the steps of shuffling rod-like filter elements of several types (e.g., two types one of which contains acetate fibers and the other of which contains acetate fibers and/or charcoal) to form a series of groups of assorted coaxial filter elements, moving successive groups of the series of groups sideways or substantially sideways, pneumatically conveying successive groups of the series lengthwise or axially and converting the pneumatically conveyed groups into a continuous line of assorted filter elements (if the filter plugs are to contain two types of filter material, the continuous line consists of alternating filter elements of first and second types), draping a continuous web of suitable wrapping material around the continuous line (preferably while the line is moved lengthwise at a predetermined speed) to form a continuous filter rod, and subdividing the rod into discrete composite filter plugs each of which contains at least a portion of at least one filter element of each type. The conveying step preferably comprises directing a stream of compressed air or another suitable gaseous fluid against one outermost filter element of each group which reaches a transfer station while being moved sideways.

The converting step may comprise accelerating successive groups of assorted filter elements to a speed exceeding the aforementioned predetermined speed and thereupon decelerating successive groups to the predeterminded speed so that the rearmost filter element of each preceding group in the continuous line is immediately adjacent to and preferably contacts the foremost filter element of the next-following group.

The method preferably further comprises the following steps which precede the shuffling step: Establishing discrete supplies of relatively long filter rod sections of each of several types (such supplies can be established by accumulating filter rod sections of each type in a discrete magazine or hopper wherein the sections are parallel to each other), withdrawing a first row of filter rod sections from each supply (e.g. by fluted rotary drum-shaped conveyors), subdividing each section of each first row into two or more shorter sections (e.g., by resorting to rotary disk-shaped knives which cooperate with the aforementioned fluted conveyors), converting the shorter sections of each type into a discrete second row of shorter sections (this can be accomplished by resorting to suitable staggering and shifting conveyors for shorter sections), subdividing successive shorter sections of each second row into a set of coaxial filter elements of the respective type (e.g., by resorting to rotary disk-shaped knives which subdivide the shorter sections into two or more filter elements), and moving the filter elements of each set apart (i.e., axially and away from each other) prior to the shuffling step so that the shuffling step can result in the formation of assorted groups wherein filter elements of different types alternate with each other.

The method may further comprise the steps of measuring the length of each set of filter elements or each group of filter elements and segregating those sets or groups (preferably prior to the conveying step) whose length deviates from a preselected range of satisfactory lengths. If the measuring step is carried out in connection with the groups, the groups are preferably condensed prior to measuring (by moving the neighboring filter elements into actual abutment with each other). The measuring of the length of successive groups is preferably preceded by the step of condensing the group; such condensing step may comprise subjecting the filter elements of each group to axial stresses to eliminate eventual clearances between neighboring filter elements of a group. Axial stresses can be transmitted by spring-biased plates or blocks which flank the path of movement of successive groups toward a transfer station where the groups begin to move axially.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a side elevational view of the group assembling unit of the improved apparatus, substantially as seen in the direction of arrows from the line II—II of FIG. 1;

FIG. 3 shows various stages of transformation of several types of filter rod sections into groups of assorted filter elements;

FIG. 4 shows, on a larger scale, a detail of the assembling unit which is illustrated in FIG. 2;

FIG. 5 is a schematic end elevational view of two group-condensing cams in the assembling unit of FIG. 2;

FIG. 6 is a similar schematic end elevational view of a device which measures the length of groups of filter elements in the assembling unit of FIG. 2;

DESCRIPTION OF THE PREFERRED EMBODIMENTS

Figure 1:
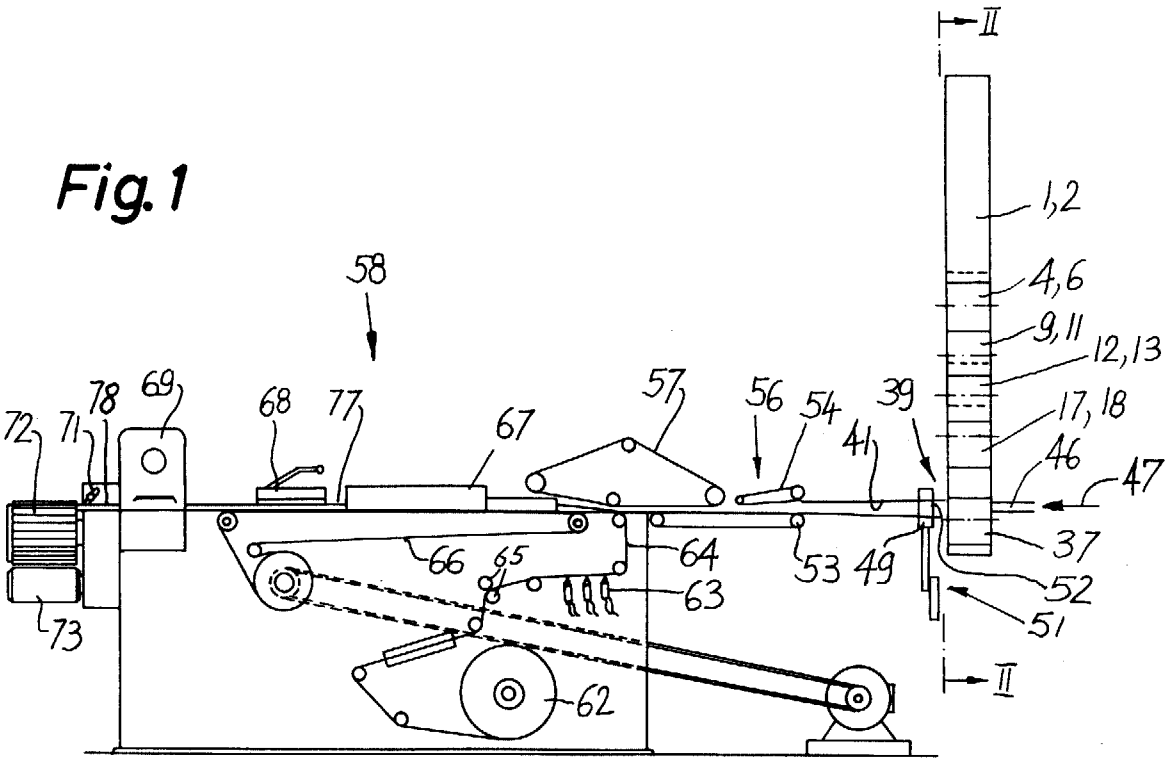
FIG. 1 is a diagrammatic front elevational view of an apparatus which includes a filter rod making machine and embodies one form of the invention.

Referring first to FIGS. 1 and 2, there is shown an apparatus for making composite filter plugs 78. The apparatus comprises a group assembling unit which is shown in detail in FIG. 2 and includes two magazines or hoppers 1 and 2 which respectively contain filter rod sections 74 of a first type and filter rod sections 74' of a second type. Each filter rod section 74 or 74' (see FIG. 3) is of six times unit length. The magazines 1 and 2 have inlet openings 3 flanked by belt conveyors 3a which feed filter rod sections 74 and 74' sideways into the lower portions of the respective magazines. The apparatus for supplying filter rod sections 74, 74' into the range of the respective belt conveyors 3a may be of the type known as FT produced by Hauni-Werke, Hamburg-Bergedorf, Western Germany. Such apparatus is described in U.S. Pat. No. Re 28,383 granted Apr. 8, 1975 to Rudszinat.

The discharge openings 3A in the lower end portions of the magazines 1 and 2 respectively supply filter rod sections 74 and 74' to the flutes of two drum-shaped severing conveyors 4 and 6 which respectively cooperate with rotary disk-shaped knives 7, 8 to subdivide each filter rod section 74, 74' into two filter rod sections 74A, 74A' (FIG. 3) of three times unit length. The flutes of the conveyors 4, 6 respectively deliver pairs of filter rod sections 74A, 74A' to staggering conveyors 9, 11 which move the filter rod sections sideways and simultaneously move the filter rod sections of each pair with respect to each other (in the circumferential direction of the respective staggering conveyors). The staggering conveyor 9 causes the sections 74 to form two rows wherein the sections of one row are out of axial alignment with the sections of the other row. The conveyor 9 may comprise two fluted drums which are driven and mounted in such a way that their flutes are aligned at the transfer station where such flutes receive pairs of sections 74A from the severing conveyor 4 but are not in register with each other at the transfer station between the drums of the conveyor 9 and a drum-shaped shifting conveyor 12 having flutes each of which receives a single section 74A. The conveyor 12 cooperates with one or two stationary cams 14 which move alternate sections 74A axially behind the adjacent sections 74A so that such sections form a single row wherein each preceding section 74A is in exact register with the next-following section. The manner in which the drums of the staggering conveyor 11 manipulate the filter rod sections 74A' and the manner in which a shifting conveyor 13 cooperates with one or two stationary cams 16 to form a single row of registering sections 74A' is the same as described in connection with the conveyors 9, 12 and cam or cams 14.

The flutes of the shifting conveyor 12 deliver the sections 74A of the single row into successive flutes of a drum-shaped severing conveyor 17 cooperating with two rotary disk-shaped knives 19 (only one shown in FIG. 2) to subdivide each section 74A into a set of three coaxial sections or filter elements 74B of unit length. The sections 74B of each set are thereupon spread apart by two stationary cams 22 (one shown in FIG. 2) which are adjacent to the conveyor 17 immediately downstream of the knives 19. When the filter elements or sections 74B of a set move beyond the cams 22, they are separated from each other by gaps 74D shown in FIG. 3. The means for converting successive sections 74A' into sets of three coaxial sections or filter elements 74B' of unit length and for moving the sections 74B' of each set apart to provide gaps 74D' shown in FIG. 3 comprises a drum-shaped severing conveyor 18, two rotary disk-shaped knives 21 (one shown in FIG. 2) and two stationary cams 23 (one shown in FIG. 2). The width of each gap 74D at least slightly exceeds the length of a section 74B', and the width of each gap 74D' at least slightly exceeds the length of a section 74B.

The cams 22 and 23 shift the respective sections 74B, 74B' in such a way that the sections 74B of each set of three such sections which approaches the transfer station between the conveyor 17 and a shuffling conveyor 24 are aligned with the gaps 74D' of a set of sections 74B approaching the conveyor 24, and vice versa. The shuffling conveyor 24 is a rotary drum having flutes each of which receives a set of sections 74B and a set of sections 74B' whereby such sections form an elongated group 76 of assorted coaxial filter elements or sections wherein the sections 74B alternate with the sections 74B'. The flutes of the shuffling conveyor 24 deliver successive groups 76 into the flutes of a rotary drum-shaped condensing conveyor 26 which advances the thus formed row of groups 76 between two condensing cams 27 which reduce the width of the clearances between neighboring sections of a group to zero and thus form condensed groups 76A each of which has or should have a predetermined length, namely a length equal to the combined length of three standard sections 74B and three standard sections 74B'. The length of a section 74B may but need not equal the length of a section 74B'.

The condensing conveyor 26 thereupon advances successive condensed groups 76A past a length measuring device 28 the details of which are shown in FIG. 6 and which determines whether or not the length of a group 76A deviates excessively from a desired or optimum length.

The condensing cams 27 are shown in FIG. 5. Each of these cams comprise an arcuate plate **27*a* which is biased by helical springs 27*b* and successive increments of which (as considered in the direction of rotation of the condensing conveyor 26) are nearer to the centrally located sections 74B, 74B' of successive groups 76. The springs 27*b* insure that the plates 27*a* can yield when engaged by a group 76 of excessive length as well as that the plates 27*a* cannot damage or deface the two outermost sections of a group while the sections of a group 76 between the plates 27*a* are subjected to axial stresses for the purpose of eliminating eventual clearances between neighboring sections 74B, 74B' of a group 76 which is in the process of being converted into a group 76A. AS a rule, the sections of a group 76** will be separated from each other by clearances (see FIG. 3 at *g*).

The length measuring device 28 controls an ejecting device 29 (FIG. 4) which expels unsatisfactory condensed groups 76A from the respective flutes of the condensing conveyor 26 before the unsatisfactory condensed groups (which may be too short or too long) reach the flutes 38 of a rotary drum-shaped transfer conveyor 37.

The length measuring device 28 comprises a stationary guide rail 31A at one side of the path of movement of successive condensed groups 76A on the conveyor 26 and a sensing arm or feeler 31 at the other side of such path. The feeler 31 is biased against the adjacent sections 74B or 74B' of successive groups 76A by a helical spring **31*a* and is pivotally mounted at 31*b*. The feeler 31 is a bell crank lever one arm of which is biased by the spring 31*a* and the other arm of which carries two contacts 32, 33 disposed between two stationary contacts 32*a*, 33*a* in an evaluating circuit 34 of known design. The circuit 34 furnishes a signal when the contact 32 engages the contact 32*a* (in response to detection of a group 76A which is too short) or when the contact 33 engages the contact 33*a* (in response to detection of a group 76A which is too long). The circuit 34 transmits signals to the solenoid 36 of a valve 35 which is installed in a pipe 35*a* having a nozzle adapted to discharge compressed air in response to energization of the solenoid 36. Such air expels the defective group 76A from the respective flute of the conveyor 26. The source of supply of compressed air for the pipe 35*a*** is not shown in FIG. 4.

Figure 7:
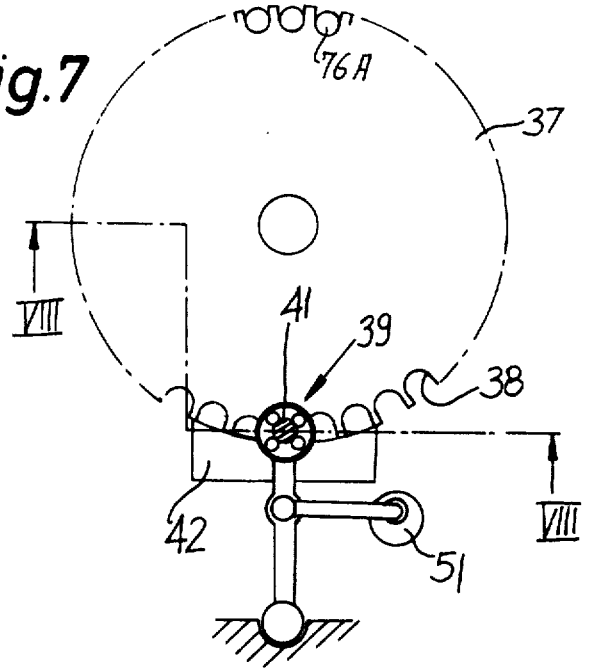
FIG. 7 is an enlarged end elevational view of a drum-shaped rotary transfer conveyor which is used in the assembling unit of FIG. 2.
Figure 8:
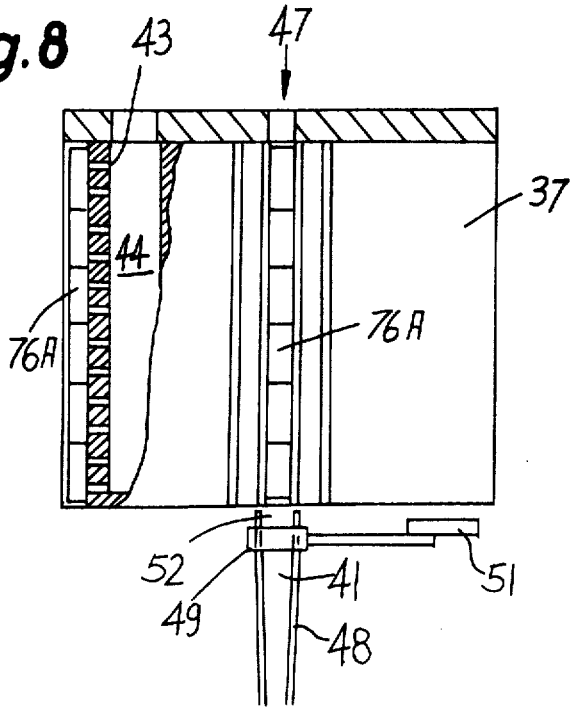
FIG. 8 is a sectional view as seen in the direction of arrows from the line VIII—VIII of FIG. 7.

Satisfactory groups 76A which reach the flutes 38 of the conveyor 37 are advanced toward a transfer station 39 (see FIGS. 7 to 9) at which successive groups of the series of groups supplied by conveyor 37 are caused to terminate their sidewise movement and to begin to move lengthwise or axially in a manner constituting an important feature of the present invention. Successive satisfactory condensed groups 76A are thereby caused to enter the inlet 52 of an elongated channel 41. Those flutes 38 of the transfer conveyor 37 which are located at and are adjacent to the transfer station 39 are overlapped by a stationary cover or shroud 42. The shroud 42 sealingly engages the periphery of the conveyor 37 so that the outer side of each flute 38 which arrives at the station 39 is fully or at least substantially sealed from the surrounding atmosphere. The transfer conveyor 37 is a hollow drum which surrounds a stationary suction chamber 44 and has radially outwardly extending ports 43 serving to attract satisfactory groups 76A to the surfaces surrounding the respective flutes 38 during transport of groups from the transfer station between the conveyors 26, 37 to the transfer station 39.

The means for terminating sidewise movement of groups 76A at the transfer station 39 and for moving the groups 76A lengthwise into and beyond the inlet 52 of the channel 41 comprises a pipe 46 (FIG. 1) which is in register with the flute 38 at the transfer station 39 and discharges a stream of compressed air in the direction indicated by arrow 47, i.e., against one outermost (rearmost) section 74B or 74B' of the group 76A which reaches the station 39. The source of compressed air for the pipe 47 is not shown in the drawing.

The conveyors 4, 6, 9, 11, 12, 13, 17, 18, 24 and 26 are preferably constructed in the same way as the conveyor 37, i.e., they can attract the sections 74, 74', 74A, 74A',74B, 74B' by suction. However, it is equally within the purview of the invention to utilize arcuate shrouds in association with some or all of the just enumerated conveyors, as long as the sections are held against ejection from the respective flutes under the action of centrifugal force and/or gravity.

Figures 9, 10, 11:
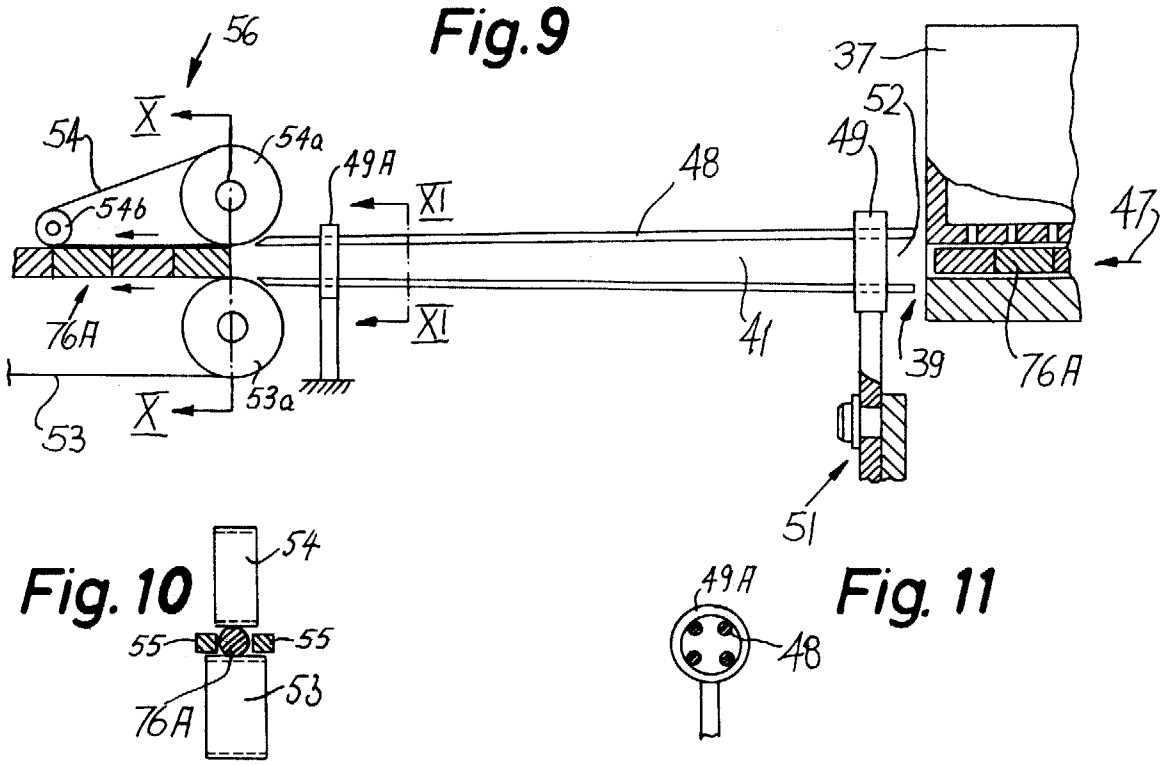
FIG. 9 is an enlarged partly elevational and partly longitudinal vertical sectional view of a detail in the apparatus of FIG. 1.
FIG. 10 is a sectional view as seen in the direction of arrows from the line X—X of FIG. 9.
FIG. 11 is a sectional view as seen in the direction of arrows from the line XI—XI of FIG. 9.

The construction of the channel 41 is shown in FIGS. 9 to 11. This channel includes four elongated elastic rods 48 which converge toward each other in the direction of lengthwise movement of groups 76A (in a direction to the left, as viewed in FIG. 9) so that the cross-sectional area of the channel decreases in the direction of axial movement of sections 74B, 74B' therein. The left-hand end portions of rods 48 (at the outlet of the channel 41) are rigidly connected to a fixedly mounted supported ring 49A, and the right-hand end portions of these rods are connected to a second supporting ring 49 which is adjacent to the inlet 52 and is coupled to an eccentric 51. The latter is driven to move the inlet 52 along an endless path in such a way that the inlet registers, for a certain interval of time, with that flute 38 of the transfer conveyor 37 which approaches, moves through and advances beyond the transfer station 39. A portion of the endless path for the inlet 52 registers with the path of movement of successive flutes 38 at the transfer station. This leaves more time for pneumatic conveying of successive condensed groups 76A into the space between the rods 48 of the channel 41.

The outlet of the channel 41 is adjacent to the inlet of a passage between the lower reach of an upper endless conveyor belt 54 and the upper reach of a lower endless conveyor belt 53. These belts are respectively trained over rollers 54*a*, 54*b* and 53*a*, 53*b* (see also FIG. 12) and together constitute an accelerating unit 56 for the groups 76A which are supplied by the channel 41. The width of the passage between the belt conveyors 53, 54 decreases slightly in the direction of forward movement of the groups 76A. The passage is flanked by two stationary guide rails 55 shown in FIG. 10.

The left-hand portion of the belt conveyor 53 (as viewed in FIG. 12) cooperates with the lower reach of a further endless belt or chain conveyor 57 which serves to decelerate successive groups 76A and is trained over rollers 57*a*, 57*b*, 57*c*. The conveyor 57 has spaced apart entraining pins or lugs 59 and the median portion of its lower reach travels along the lowermost point of a roller 57*d* which prevents excessive flexing of the conveyor 57 downstream of the roller 57*a* and above a portion of a heating device 61 which is adjacent to the underside of the path of movement of successive groups 76A. The conveyor 57 and heating device 61 form part of a filter rod making machine 58 (FIG. 1) which drapes a web 64 of cigarette paper, imitation cork or other suitable wrapping material around the line of groups 76A. The device 61 heats adhesive applied to that side of the web 64 which faces the line of groups 76A in the machine 58. The web 64 is being withdrawn from a bobbin 62 by two advancing rolls 65 and passes along the nozzles 63 of a paster before it reaches a guide roller 64*a* located immediately upstream of the heating device 61. The machine 58 further comprises a wrapping mechanism 67 which cooperates with a garniture 66 to drape the web 64 around the continuous line of groups 67A so as to convert the web into a tubular wrapper wherein one marginal portion overlies the other and forms therewith a longitudinally extending seam. The seam is thereupon heated by a sealing plate 68 and the thus obtained continuous filter rod 77 is severed at predetermined intervals by a conventional cutoff 69 so that the rod 77 yields a file of discrete composite filter plugs 78 each of which contains at least a portion of at least one section or filter element 74B and at least a portion of at least one section or filter element 74B'. Successive filter plugs 78 are accelerated by a rotating cam 71 which propels them into successive flutes of a drum-shaped row forming conveyor 72. The conveyor 72 converts the single file of filter plugs 78 into one or more rows wherein the filter plugs move sideways, and such filter plugs are transferred onto a take-off conveyor belt 73 for delivery into a filter cigarette making machine.

Figure 12:
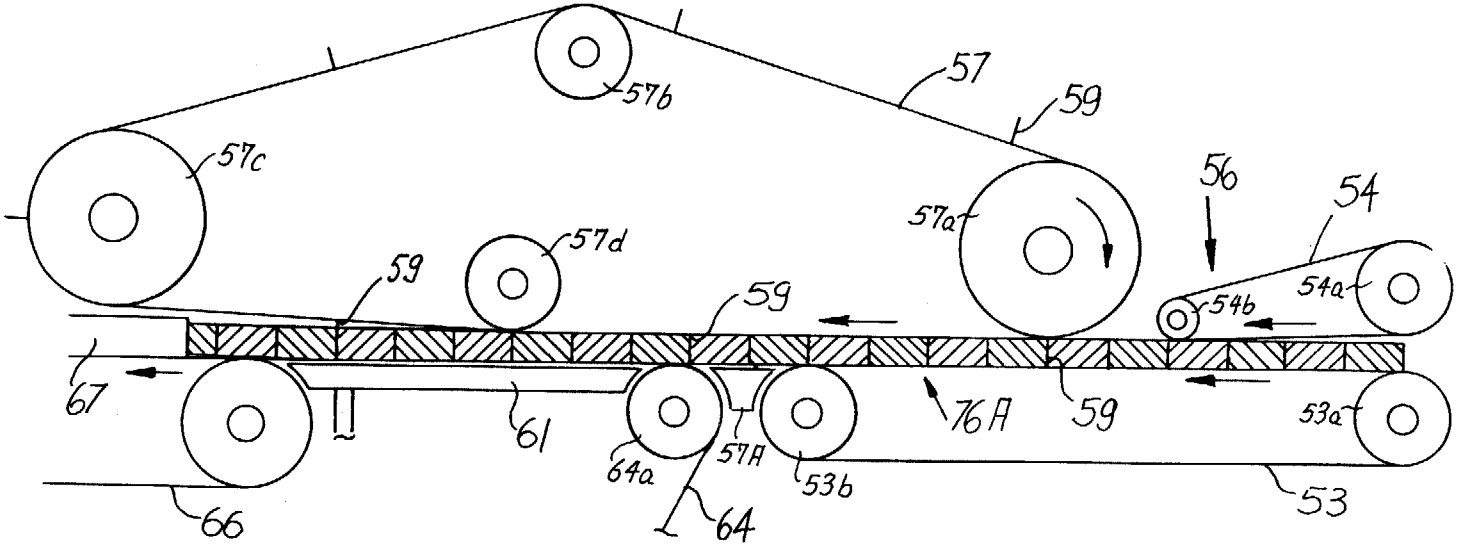
FIG. 12 is an enlarged view of another part of the apparatus which is shown in FIG. 1.

FIG. 12 further shows a short bridge 57A between the rollers 53*b* and 64*a* opposite the lower reach of the conveyor 57. The conveyor 57 places the rearmost section 74B or 74B' of each preceding group 76A into immediate proximity of the foremost section 74B' or 74B of the next-following group 76A.

The operation:

The magazines 1 and 2 respectively discharge filter rod sections 74 and 74' (see FIG. 3 at *a*) which are severed by the knives 7, 8 to yield pairs of sections 74A and 74A' (FIG. 3 at *b*). Such sections are then staggered by the conveyors 9, 11 (FIG. 3 at *c*), shifted by cams 14, 16 (FIG. 3 at *d*), severed by knives 19, 21 (FIG. 3 at *e*) to yield sets of filter elements or sections 74B, 74B', moved apart by cams 22, 23 to form gaps 74D, 74D' (FIG. 3 at *f*) and shuffled on the conveyor 24 to form groups 76 (FIG. 3 at *g*). The groups 76 are condensed by the yieldable plates 27*a* of the condensing cams 27 to be converted into groups 76A (FIG. 3 at *h*), and the length of each condensed group 76A is measured by the device 28 whose circuit 34 transmits a signal to energize the solenoid 36 of the ejecting device 29 whenever the device 28 detects a group 76A which is too short or too long.

Satisfactory groups 76A advance beyond the ejecting device 29 and are admitted into successive flutes 38 of the conveyor 37 which transports them toward the transfer station 39. Those flutes 38 which approach the station 39 are overlapped by the shroud 42 and the respective groups 76A are expelled by compressed air issuing from the nozzle of the pipe 46 to change the direction of their movement from sidewise to lengthwise and to move into, through and beyond the inlet 52 of the channel 41. The inlet 52 is oscillated by the ring 49 so that it remains in longer-lasting alignment with that group 76A which is being expelled from the respective flute 38. Since the stream of air which issues from the pipe 46 impinges against the exposed end face of the last section 74B or 74B' of a condensed group 76A, the group remains condensed during introduction into and during travel in the space between the rods 48 of the channel 41. A group 76A which enters the passage between the conveyor belts 53, 54 and rails 55 of the accelerating unit 56 is thereupon advanced at a predetermined speed which exceeds the speed of the conveyor belt 57. Therefore, the foremost section 74B or 74B' of a group 76A which is being advanced by the unit 56 reaches and is decelerated by a pin or lug 59 of the conveyor 57 to thereupon advance at the speed of this conveyor. The next-following pin or lug 59 moves behind the last section 74B or 74B' of such group 76A and advances the group above the heating device 61 and onto the garniture 66 of the filter rod making machine 58. The conveyor 57 converts discrete groups 76A into a continuous line of such groups because each of those pins or lugs 59 which move beyond the roller 57*a* is located behind the rearmost section 74B or 74B' of a preceding group 76A and in front of the foremost section 74*b'* or 74B of the next-following group 76A. The speed of the conveyor 57 can be synchronized with the speed of the advancing rolls 65 and garniture 66 as well as with operation of the cutoff 69 in such a way that each composite filter plug 78 contains one section 74B and one section 74B'. Thus the length of each composite filter plug 78 can equal one-third the length of a section 74A plus one-third the length of a section 74A'. The manner in which the machine 58 drapes the web 64 around the continuous line of groups 76A is known and forms no part of the invention, i.e., the continuous line of groups 76A can be treated substantially in the same way as a continuous tow of filamentary filter material or a continuous rod-like tobacco filler.

Figure 13:
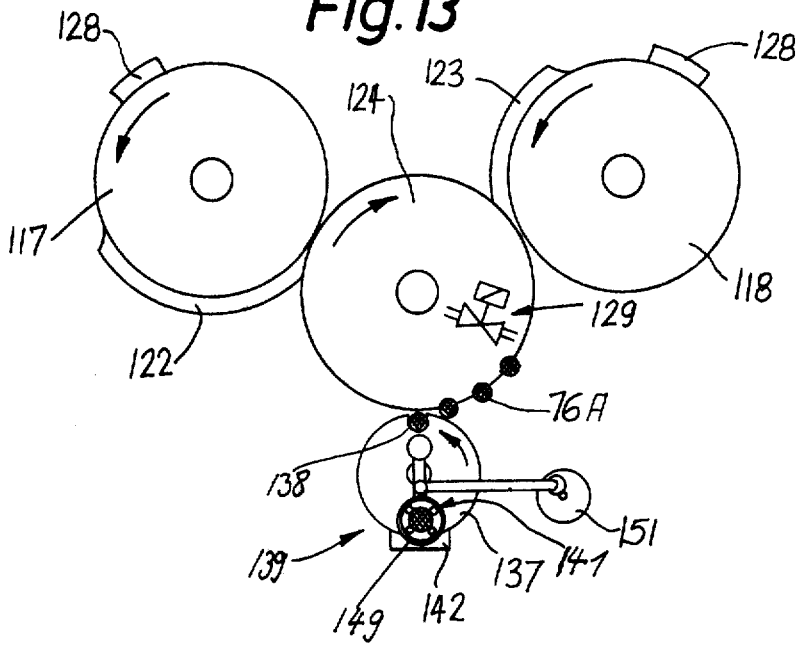
FIG. 13 illustrates a portion of a second apparatus having a different group aSsembling unit.

FIG. 13 shows a portion of a second apparatus which dispenses with the condensing conveyor 26 of FIG. 2. The shuffling conveyor 124 receives sets of spaced apart filter elements or section 74B and 74B' from the severing conveyors 117, 118 which cooperate with cams 122, 123. The apparatus which includes the structure of FIG. 13 has two length measuring devices 128 which are adjacent to the severing conveyors 117, 118 and respectively measure the length of sets of filter rod sections 74B, 74B' or discrete sections 74A, 74A' (depending upon whether the devices 128 are installed downstream or upstream of the knives (corresponding to knives 19, 21 of FIG. 2) which cooperate with the conveyors 117, 118 to subdivide successive sections 74A, 74A' into sets of sections 74B, 74B'. Each of the length measuring devices 128 can actuate an ejecting device 129 which then expels the corresponding group 76 or 76A from the respective flute of the conveyor 124. The conveyor 124 delivers satisfactory groups 76A (the condensing cams for the groups 76 are not shown in FIG. 13) into the oncoming flutes 138 of the conveyor 137 which delivers such groups to the transfer station 139. FIG. 13 further shows the channel 141, the shroud 142 and the eccentric 151 for the ring 149 which oscillates the inlet of the channel 141. The transfer station 139 is located at the lowermost point of the conveyor 137. It will be noted that all such parts of the apparatus shown in FIG. 13 which are identical with or clearly analogous to the corresponding parts of the apparatus of FIGS. 1 to 12 are denoted by similar reference characters plus 100.

Figure 14:
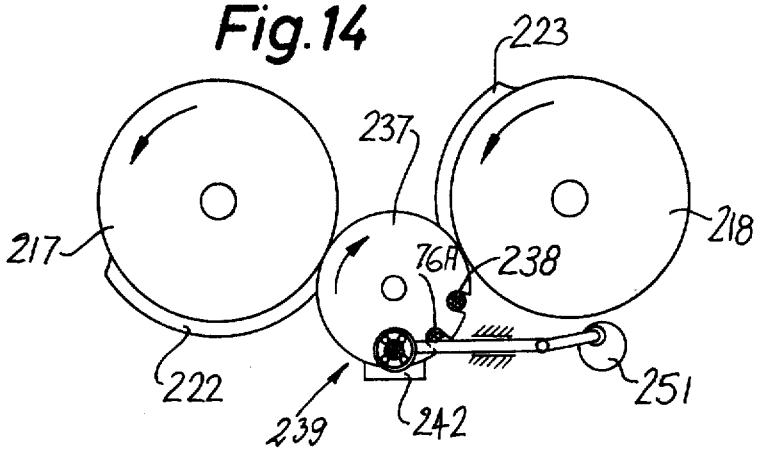
FIG. 14 is a similar view of a portion of a third apparatus having a group assembling unit which constitutes a modification of the unit shown in FIG. 13.

FIG. 14 shows a portion of a third apparatus wherein all such parts which are identical with or analogous to the corresponding parts of the first apparatus are denoted by similar reference characters plus 200. In this apparatus, the transfer conveyor 237 performs the function of a shuffling conveyor, i.e., it receives sets of filter elements or sections 74B from the flutes of the severing conveyor 217 and sets of filter elements or sections 74B' from the flutes of the severing conveyor 218. The groups 76 can be condensed during travel in the flutes 238 on their way toward the transfer station 239. The length measuring device or devices are not shown; such device or devices are optional but desirable in each embodiment of the improved apparatus.

Figure 15:
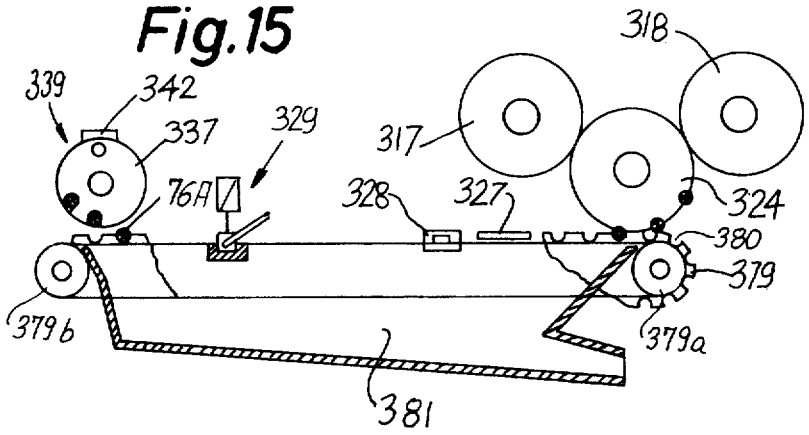
FIG. 15 is a fragmentary schematic partly elevational and partly sectional view of a fourth apparatus wherein the length of successively assembled groups of assorted filter elements is measured during travel of groups with the upper reach of an endless belt or chain conveyor.

FIG. 15 shows a portion of a fourth apparatus wherein the drum-shaped condensing conveyor 26 of FIG. 2 is replaced with an endless belt or chain 379 having cradles 380 and being trained over pulleys or sprocket wheels 379*a*, 379*b*. The shuffling conveyor 324 receives sets of filter elements or sections 74B, 74B' from two severing conveyors 317, 318 and delivers successive groups 76 into successive cradles 380 of the conveyor 379. The latter moves successive groups 76 sideways between the condensing cams 327 and thereupon through a length measuring device 328 which controls the operation of an ejecting device 329. Satisfactory condensed groups 76A are accepted by the flutes of the transfer conveyor 337 which delivers them to the transfer station 339 where the flutes are overlapped by the shroud 342. The groups which are received in cradles 380 moving with the horizontal upper reach of the conveyor 379 are attracted to such cradles by a suction chamber 381 which extends from one side into the space between the upper and lower reaches of 379.

Figure 16:
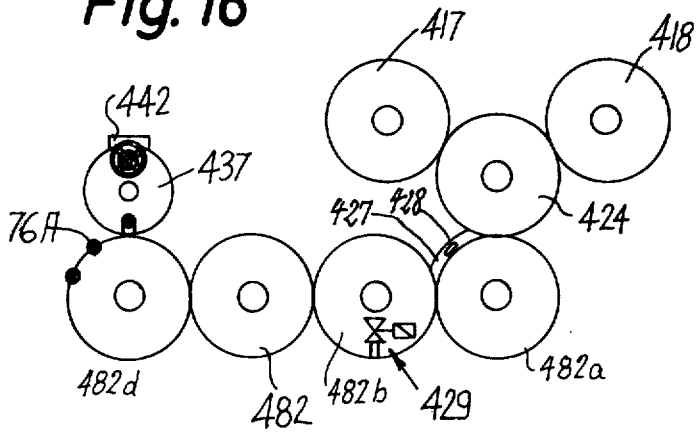
FIG. 16 illustrates a structure which constitutes a modification of the structure shown in FIG. 15.

In the apparatus of FIG. 16, the drum-shaped conveyor 26 of FIG. 2 or the endless flexible conveyor 379 of FIG. 15 is replaced with a set of four drum-shaped rotary intermediate conveyors 482*a*, 482*b*, 482*c*, 482*d*. The conveyor 482*a* receives groups 76 from the shuffling conveyor 424 (which cooperates with severing conveyors 417, 418) and transports successive groups past condensing cams 427 which can incorporate a length measuring device 428. The conveyor 482*b* transports condensed groups 76A past an ejecting device 429 which receives signals from the length measuring device 428, the conveyor 482*c* allows for visual inspection of satisfactory groups 76A, and the conveyor 482*d* delivers groups 76A to the flutes of the transfer conveyor 437 which transports the groups to the transfer station below the shroud 442. The number of intermediate conveyors 482 can be reduced to three or two, e.g., the conveyor 482*b* could deliver satisfactory groups 76A directly to the flutes of the conveyor 437.

Figure 17:
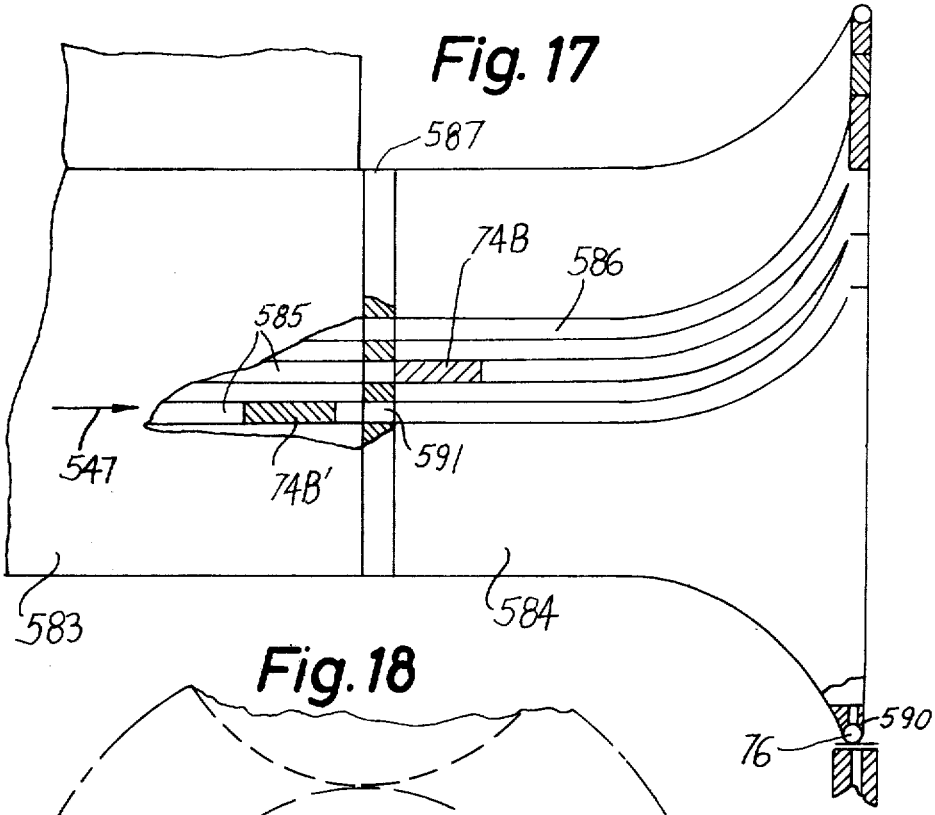
FIG. 17 is a schematic partly elevational and partly sectional view of a different transfer conveyor.
Figure 18:
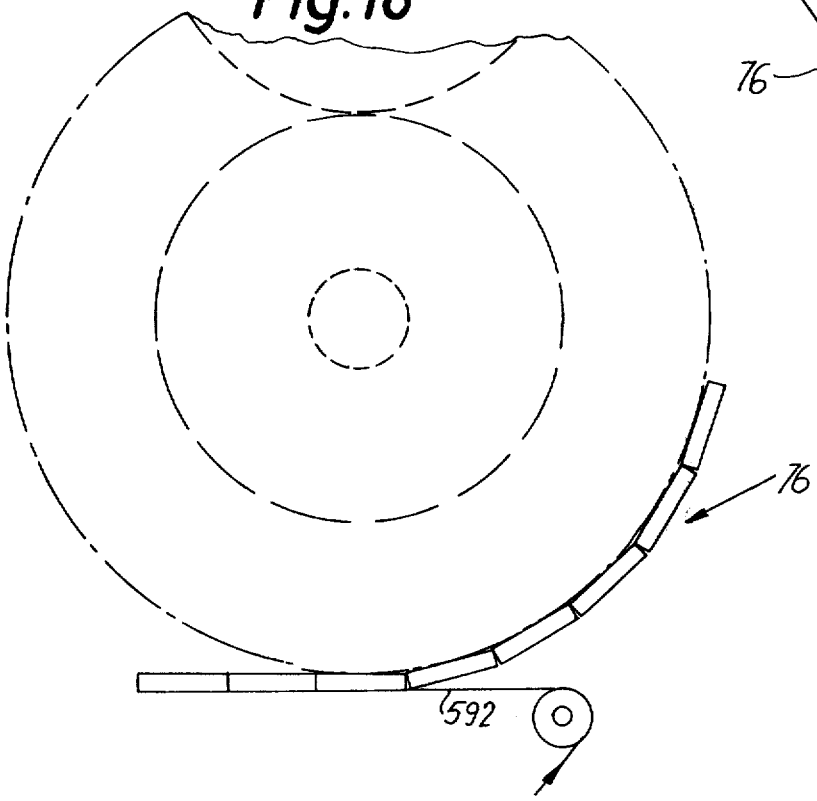
FIG. 18 is a view as seen from the right-hand side of FIG. 17.

FIGS. 17 and 18 illustrate a transfer conveyor which can replace the conveyor 37 of FIG. 2. The conveyor includes a rotary drum 583 whose flutes 585 can receive discrete filter elements or sections 74B, 74B' and a turn-around or reorienting device 584 which is coaxial with and is rotated at the speed of the drum 583. The flutes 585 are parallel to the axis of the drum 583. The turn-around device 584 has peripheral flutes or grooves 586 each of which has a straight portion parallel to the axis of the drum 583 and a helical portion which merges into the respective straight portion and extends all the way to a ring-shaped circumferential groove 590 at the right-hand end of the device 584, as viewed in FIG. 17. A guide ring 587 with straight flutes or bores 591 is disposed between the drum 583 and turn-around device 584. Alternate flutes 585 of the drum 583 receive discrete sections 74B, 74B' and move past a pipe (indicated only by arrow 547) which discharges compressed air to propel the section 74B, 74B' into alternate grooves 596. The sections move axially in the left-hand portions of grooves 586 and thereupon move along helical paths to be assembled into a line of groups 76 of alternating sections 74B, 74B' when they reach the groove 590. The sections in the groove 590 move at right angles to the axis of the drum 583. The groups 76 are delivered onto a belt conveyor 592 which corresponds to the conveyor 53 or 54 of FIG. 9 or to the garniture 66 of FIG. 1.

The means for feeding sections 74B, 74B' to the flutes 585 may include a first drum-shaped conveyor which supplies sections 74B into oddly numbered flutes 585 and a second drum-shaped conveyor which supplies sections 74B' into evenly numbered flutes 585.

An advantage of the improved method and apparatus is that a continuous line of assorted filter elements or sections of several types can be assembled at a speed which greatly exceeds the speed of assembling a continuous line of assorted filter elements by conventional mechanical means. Moreover, pneumatic conveying of successive groups in the axial direction of the respective filter elements does not result in deformation and/or damage to the filter elements. Still further, the improved method and apparatus can produce a continuous line of assorted filter elements with a much higher degree of reliability (without undesirable clearances between neighboring filter elements) than in accordance with heretofore known techniques, even if the speed at which the line of assorted filter elements is being formed and moved lengthwise exceeds (e.g. several times) the speed of assembly and movement of the line in a conventional apparatus. Finally, pneumatic conveying of groups in the axial direction of the respective filter elements is much less likely to result in malfunction of the apparatus than if the direction of movement of successive groups were changed exclusively by mechanical means.

Without further analysis, the foregoing will so fully reveal the gist of the present invention that others can, by applying curent knowledge, readily adapt it for various applications withou omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

1. A method of making composite filter plugs for cigarettes or the like, comprising the steps of shuffling rod-like filter elements of several types to form a series of groups of assorted coaxial filter elements; moving successive groups of said series sideways; pneumatically conveying successive groups of said series lengthwise, including directing a stream of compressed gaseous fluid against one outermost filter element of each of said successive groups, and converting the pneumatically conveyed groups into a continuous line of filter elements; draping a continuous web around said line to form a continuous filter rod; and subdividing the rod into discrete filter plugs each of which contains at least a portion of at least one filter element of each of said several types.

2. A method as defined in claim 1, further comprising the steps of measuring the length of each of said groups and segregating those groups whose length deviates from a preselected range of lengths.

3. A method as defined in claim 1, further comprising the step of moving said continuous line lengthwise at a predetermined speed, said converting step comprising accelerating successive groups to a speed exceeding said predetermined speed and thereupon decelerating successive groups to said predetermined speed so that the rearmost filter element of each preceding group in said continuous line is immediately adjacent to the foremost filter element of the next-following group.

4. A method as defined in claim 1, further comprising the steps of establishing discrete supplies of filter rod sections of each of said types, withdrawing a first row of filter rod sections from each of said supplies, subdividing each section of each of said rows into several shorter sections, converting the shorter sections of each of said types into a discrete second row of shorter sections, subdividing successive shorter sections of each of said second rows into a set of coaxial filter elements of the respective type, and moving the filter elements of each of said sets apart prior to said shuffling step.

5. A method as defined in claim 4, further comprising the steps of measuring the length of each of said sets of filter elements and segregating those sets whose length deviates from a preselected range of lengths.

6. A method as defined in claim 2, further comprising the step of condensing said groups prior to said measuring step, said condensing step comprising subjecting the filter elements of each group to axial stresses to eliminate clearances between neighboring filter elements.

7. Apparatus for the production of composite filter plugs for cigarettes or the like, comprising means for assembling rod-like filter elements of several types into a series of groups of assorted coaxial filter elements including means for moving successive groups of said series to a transfer station, said moving means comprising a rotary drum-shaped transfer conveyor having flutes which move seriatim toward, past and beyond said station and wherein said groups move to said station; means for pneumatically conveying each group which arrives at said station in the axial direction of the respective filter elements; a channel for pneumatically conveyed groups of assorted filter elements, the cross-sectional area of said channel decreasing in the direction of axial movement of said filter elements and said channel having an inlet adjacent to said station; means for maintaining said inlet in temporary register with a flute at said station, including means for moving said inlet along an endless path a portion of which coincides with the path of movement of successive flutes at said station; means for converting said pneumatically conveyed groups into a continuous line of assorted filter elements; means for draping a continuous web around said line to form a continuous rod; and means for subdividing said rod into discrete filter plugs each of which contains at least a portion of at least one filter element of each of said types.

8. Apparatus as defined in claim 7, wherein said channel comprises a plurality of elongated elastic rods and has an outlet, and further comprising stationary means for fixedly supporting said outlet, said means for moving said inlet comprising second supporting means rigid with said inlet and eccentric drive means for said second supporting means.

9. Apparatus for the production of composite filter plugs for cigarettes or the like, comprising means for assembling rod-like filter elements of several types into a series of groups of assorted coaxial filter elements, including means for moving successive groups of said series to a transfer station; means for pneumatically conveying each group which arrives at said station in the axial direction of the respective filter elements, including means for directing a stream of compressed gaseous fluid against one outermost filter element of a group at said transfer station; means for converting said pneumatically conveyed groups into a continuous line of assorted filter elements; means for draping a continuous web around said line to form a continuous rod; and means for subdividing said rod into discrete filter plugs each of which contains at least a portion of at least one filter element of each of said types.

10. Apparatus as defined in claim 8, wherein said means for moving said groups sideways comprises a rotary drum-shaped conveyor having flutes parallel to the axis of said drum-shaped conveyor and arranged to travel past said station, said assembling means further comprising means for supplying filter elements of said groups into said flutes upstream of said station.

11. Apparatus as defined in claim 10, wherein said assembling means further comprises a plurality of conveyors for filter elements of each of said types, said last mentioned conveyors having means for moving the respective filter elements sideways toward said rotary drum-shaped conveyor.

12. Apparatus as defined in claim 10, further comprising a shroud overlying the flutes of said drum-shaped conveyor at said transfer station.

13. Apparatus as defined in claim 8, further comprising means for moving said line and said rod at a predetermined speed, said converting means comprising means for accelerating successive pneumatically conveyed groups to a speed exceeding said predetermined speed and means for decelerating successive accelerated groups to said predetermined speed and for placing the rearmost filter element of each preceding group of said line into immediate proximity of the foremost filter element of the next-following group.

14. Apparatus as defined in claim 8, wherein said assembling means further comprises discrete magazines for filter rod sections of each of said types, each of said sections having a length which is a multiple of the length of a filter element of the respective type, means for withdrawing a first row of sections from each of said magazines, means for subdividing each section of each of said rows into a plurality of shorter sections, means for converting the shorter sections of each of said types into a discrete second row, means for subdividing each shorter section of each second row into a set of coaxial filter elements of the respective type, means for moving the filter elements of each of said set axially and away from each other, and means for shuffling said sets of filter elements to form said series of groups.

15. Apparatus as defined in claim 14, wherein said assembling means further comprises means for condensing successive groups of assorted filter elements between said shuffling means and said moving means.

16. Apparatus as defined in claim 15, further comprising means for measuring the length of each condensed group and means for ejecting each group whose length is outside of a preselected range of lengths.

17. Apparatus as defined in claim 8, further comprising a channel for pneumatically conveyed groups of assorted filter elements, the cross-sectional area of said channel decreasing in the direction of axial movement of said filter elements.

18. Apparatus as defined in claim 17, wherein said means for moving said groups sideways comprises a rotary drum-shaped transfer conveyor having flutes which mover seriatim toward, past and beyond said station and wherein said groups move to said station, said channel having an inlet adjacent to said station and further comprising means for maintaining said inlet in temporary register with a flute at said station.

19. Apparatus as defined in claim 9, wherein said assembling means further comprises a shuffling conveyor which converts discrete filter elements into said groups, a plurality of drum-shaped intermediate conveyors for transporting said groups from said shuffling conveyor to said moving means, means for condensing successive groups on said intermediate conveyors, means for measuring the length of condensed groups on said intermediate conveyors, and means for ejecting from said intermediate conveyors each such group whose length is outside of a preselected range of lengths.

20. Apparatus as defined in claim 9, wherein said moving means comprises a rotary drum having flutes for said filter elements and a turn-around device rotatable with said drum and having portions defining paths which receive filter elements from said flutes and wherein said filter elements are reoriented to change the direction of their movement from substantially parallel with to substantially normal to the axis of said drum.

21. Apparatus as defined in claim 8, wherein said assembling means further comprises a shuffling conveyor and means for supplying sets of filter elements of each of said types of said shuffling conveyor, said shuffling conveyor being arranged to convert the thus supplied sets of filter elements into said series of groups and to deliver such groups directly to said moving means.

22. Apparatus as defined in claim 8, wherein said assembling means further comprises a discrete severing conveyor for filter elements of each of said types, means for supplying filter rod sections of respective types to said severing conveyors, each such section having a length which is a multiple of the length of the respective filter elements, and means for subdividing successive sections on said conveyors into sets of coaxial filter elements of the respective type, said severing conveyors being arranged to supply said sets of filter elements directly to said moving means.

23. Apparatus as defined in claim 8, wherein said assembling means further comprises an endless flexible element arranged to supply said groups to said moving means, a shuffling conveyor arranged to supply groups to said flexible element, means for condensing successive groups on said flexible element, means for measuring the length of successive condensed groups on said flexible element, and means for ejecting from said flexible element each such group whose length is outside of a preselected range of lengths.

24. Apparatus as defined in claim 23, wherein said flexible element is an endless belt conveyor having cradles for transport of groups and an elongated reach which receives groups from said shuffling conveyor and whereon said groups are condensed, measured and unsatisfactory groups ejected upstream of said moving means.

* * * * *